US005781638A

United States Patent [19]

Hosaka et al.

[11] Patent Number: 5,781,638

[45] Date of Patent: Jul. 14, 1998

[54] ELECTRO-ACOUSTIC TRANSDUCER

[75] Inventors: Akihiko Hosaka, Tokyo; Kazuhisa Kito, Chiba; Kensaku Abe, Saitama, all of Japan

[73] Assignee: Sony Corporation, Tokyo, Japan

[21] Appl. No.: 695,577

[22] Filed: Aug. 12, 1996

[30] Foreign Application Priority Data

Aug. 23, 1995 [JP] Japan ..... 7-237631

[51] Int. Cl.[6] ..... H04R 25/00

[52] U.S. Cl. ..... 381/69; 381/183; 381/187

[58] Field of Search ..... 381/69, 183, 187, 381/68.6, 68.5, 23.1, 168, 169, 188, 205; 181/130; 379/428, 431, 433

[56] References Cited

U.S. PATENT DOCUMENTS

| | | | |
|---|---|---|---|
| Re. 515,294 | 8/1967 | Martin | 381/68.6 |
| 3,865,998 | 2/1975 | Weiss et al. | 381/68.6 |
| 3,983,336 | 9/1976 | Malek et al. | 179/107 FD |
| 4,069,400 | 1/1978 | Johanson et al. | 381/68.6 |
| 4,443,668 | 4/1984 | Warren | 381/69 |
| 4,880,076 | 11/1989 | Ahlberg et al. | 381/68.6 |
| 4,969,534 | 11/1990 | Kolpe et al. | 381/68.6 |
| 5,381,484 | 1/1995 | Claes et al. | 381/68.6 |
| 5,395,168 | 3/1995 | Leenen | 381/68.6 |
| 5,438,626 | 8/1995 | Neuman et al. | 381/68.6 |

*Primary Examiner*—David R. Hudspeth
*Assistant Examiner*—Rexford N. Barnie
*Attorney, Agent, or Firm*—Jay H. Maioli

[57] ABSTRACT

An electro-acoustic transducer having a main body portion 4 housing at least a speaker unit, a pinna inserting portion 5 protruding from the main body portion and adapted for being inserted into a pinna of a user, an elastically deformable auditory canal fitting portion 12, 51 provided on the outer periphery of the pinna inserting portion and an insertion control portion 46, 52 for controlling an insertion position of the auditory canal fitting portion 12, 51 into the auditory canal. By inserting the pinna inserting portion 5 into the pinna, the auditory canal fitting portion 12, 51 is deformed to conform to the shape of the auditory canal and fitted in the auditory canal in this state for hermetically sealing the auditory canal. The insertion control portion 46, 52 is retained by a portion of the pinna for controlling the inserting position of the auditory canal fitting portion 12, 51 in the auditory canal. The electro-acoustic transducer may be attached in a stable state with optimum attachment feeling for any user to enable the playback sound to be heard with satisfactory acoustic characteristics.

9 Claims, 9 Drawing Sheets

ELECTRO-ACOUSTIC TRANSDUCER

BACKGROUND OF THE INVENTION

1. Field of the Invention

This invention relates to an electro-acoustic transducer, such as an earphone, having a main body portion housing at least a speaker unit therein and an pinna inserting portion provided on the main body portion, and a pinna attachment member employed for the electro-acoustic transducer.

2. Description of the Related Art

Heretofore, in an earphone device attached to the ear of a user during use, such an earphone device has been proposed in which, for assuring stable attachment to the pinna of the user, a pinna attachment is protuberantly formed on the main body portion of an earphone the main body portion having a speaker unit housed therein, and a portion of the pinna attachment is inserted into the auditory canal for attachment to the pinna.

The pinna attachment 101 provided on the earphone device has a main body portion 103 having an acoustic duct 102 and a tapered auditory canal inserting portion 104 which provided at the distal end of the main body portion 103. This pinna attachment 101 has the distal end of the auditory canal inserting portion 104 which is inserted into the auditory canal and has the main body portion 103 engaged in the cavity of the outer ear, as shown in FIGS. 1 and 2. The earphone device, thus formed with the pinna attachment 101, has a portion of the auditory canal insertion portion 104 thereof inserted into the auditory canal, so that it is safeguarded against accidental detachment and can be attached to the pinna in a fairly stable state.

The pinna differs in size and shape from person to person. On the other hand, the pinna attachment 101 is formed by molding a synthetic resin material of high toughness, so that it is constant in shape and cannot be deformed freely. The earphone device having the pinna attachment 101 of a constant shape cannot be worn by every person with satisfactory attachment feeling.

SUMMARY OF THE INVENTION

It is therefore an object of the present invention to provide an electro-acoustic transducer and a pinna attachment therefor which can be worn by every person in a stabilized state with satisfactory attachment feeling.

It is another object of the present invention to provide an electro-acoustic transducer and a pinna attachment therefor which can be attached in such a position to hermetically seal the auditory canal and suppresses the noise of an external environment liable to enter the auditory canal, while enabling the reproduced sound to be heard with satisfactory acoustic characteristics without deteriorating the quality of the sound radiated from a speaker unit.

In one aspect, the present invention provides an electro-acoustic transducer including a main body portion housing at least a speaker unit, a pinna inserting portion protruded from the main body portion and adapted for being inserted into a pinna of a user, an elastically deformable auditory canal fitting portion provided on the outer periphery of the pinna inserting portion and an insertion control portion for controlling an insertion position of the auditory canal fitting portion into the auditory canal.

Preferably, the auditory fitting portion and the insertion control portion are integrally formed.

With the electro-acoustic transducer, if the pinna fitting portion is inserted into the pinna of the user, the auditory canal fitting portion is deformed to conform to the shape of the auditory canal and fitted in this state in the auditory canal for hermetically sealing the auditory canal. Moreover, the insertion control portion is retained by a portion of the pinna for controlling excess insertion of the auditory canal fitting portion in the auditory canal.

In another aspect, the present invention provides a pinna attachment for an electro-acoustic transducer including a mounting portion fitted to a pinna insertion portion inserted into a pinna of a user and protruding from a main body portion of an electro-acoustic transducer at least housing a speaker unit, an elastically deformable auditory canal fitting portion having its end connected to the distal end of the mounting portion and having its other end swollen in shape as a free end covering the outer periphery of the mounting portion, and an insertion control portion formed on the proximal end of the mounting portion.

The pinna attachment is attached to the outer periphery of the pinna inserting portion by having the mounting portion fitted in the pinna inserting portion provided on the electro-acoustic transducer.

With the electro-acoustic transducer and the pinna attachment for the electro-acoustic transducer according to the present invention, when the pinna inserting portion is inserted in the pinna, the auditory canal fitting portion is deformed to conform to the shape of the auditory canal and fitted in this state in the auditory canal. Thus the pinna attachment can be attached satisfactorily in stable state for any person regardless of the shape of the pinna which may vary from person to person.

In addition, since the auditory canal fitting portion is deformed to conform to the shape of the pinna and fitted therein in this state, the auditory canal can be positively hermetically sealed by the auditory canal fitting portion. Consequently, the noise of the external environment will be prohibited from entering the auditory canal and the playback sound can be heard with optimum acoustic characteristics without deterioration in the quality of the sound radiated from the speaker unit.

DESCRIPTION OF THE PREFERRED EMBODIMENTS

Figure 1:
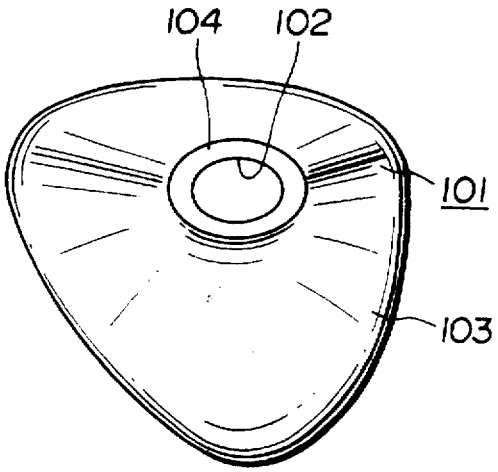
FIG. 1 is a front view showing a conventional pinna attachment.
Figure 2:
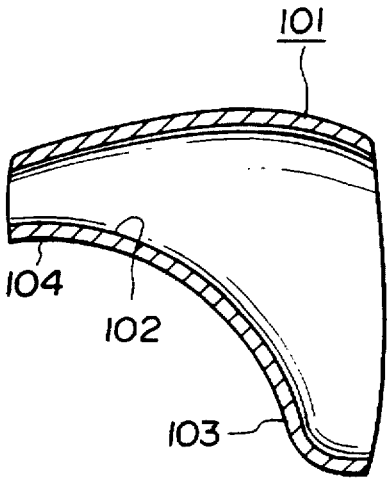
FIG. 2 is a cross-sectional view showing the conventional pinna attachment.

Referring to the drawings, preferred embodiments of the present invention will be explained in detail.

Referring to FIGS. 3 to 6, an earphone device according to the present invention includes a speaker unit 1 for reproducing speech signals supplied from a speech signal source, such as an optical disc player, an acoustic duct 2 for conducting the playback sound radiated from the speaker unit 1 to the auditory canal of the pinna, a microphone unit 3 for collecting the sound of an external environment and a housing 4 for accommodating the speaker unit 1 and the microphone unit 3.

Figure 5:
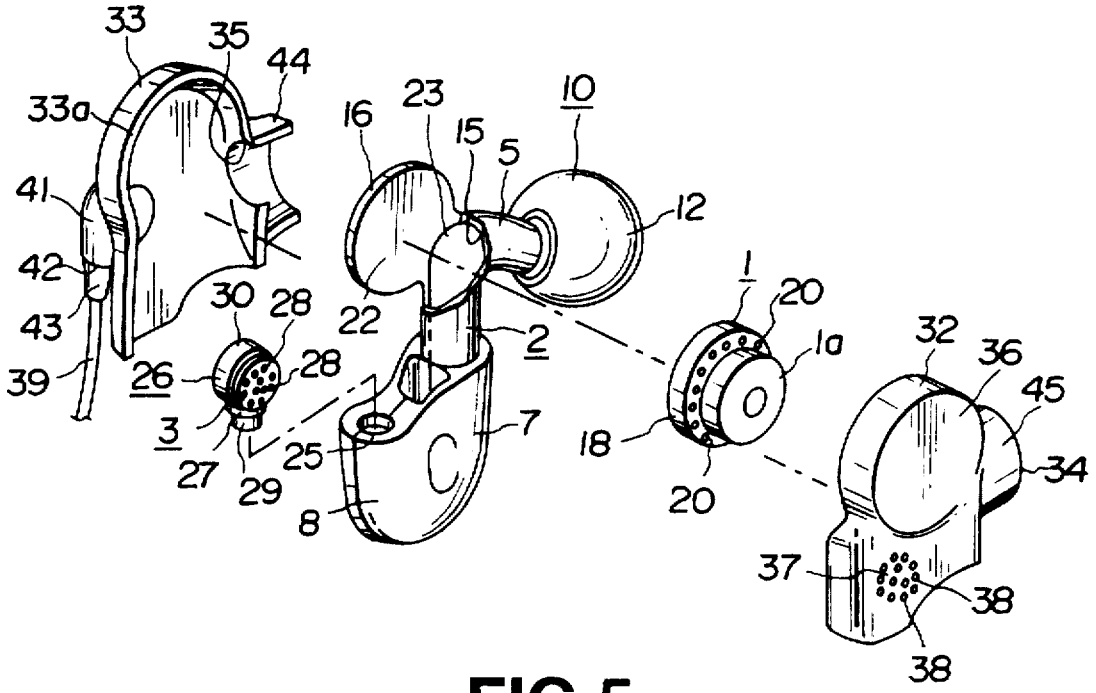
FIG. 5 is an exploded perspective view showing the earphone device of FIG. 3 looking at a surface thereof showing the sound radiating surface of a microphone unit.
Figure 6:
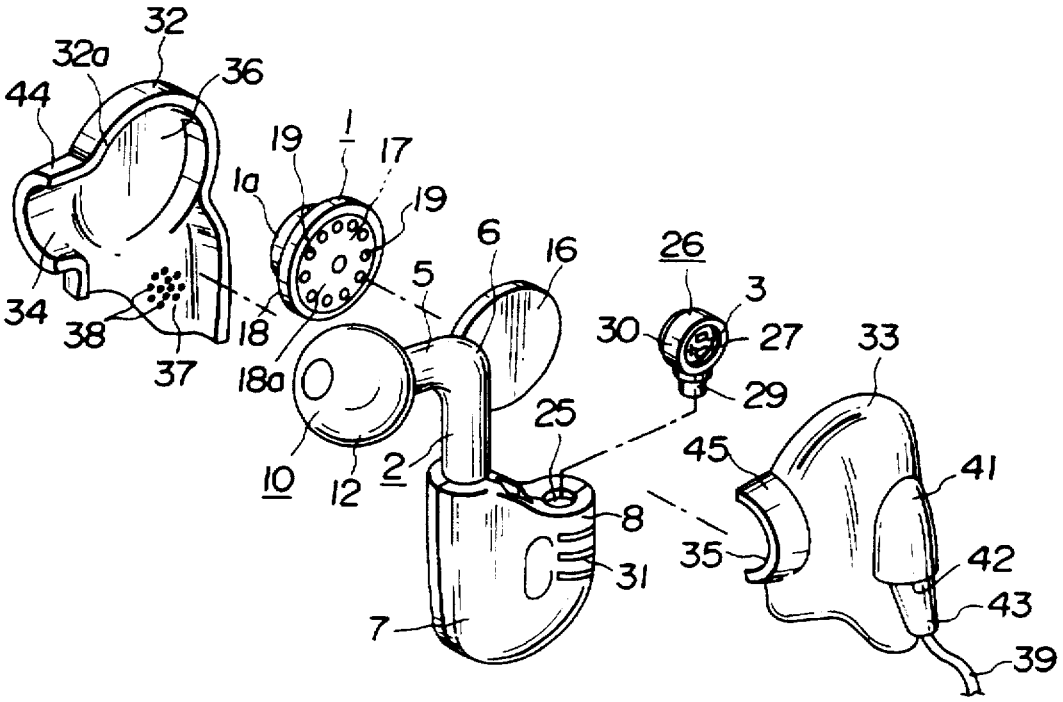
FIG. 6 is an exploded perspective view of the earphone device of FIG. 3 looking at a cord holding portion.

The acoustic duct 2 for conducting the playback speech radiated from the speaker unit 1 to the auditory canal b of a pinna a has a pinna inserting portion 5 at one end and a main duct member 7 connected to the pinna inserting portion 5 via a bent portion 6 and extending to a lower portion of the pinna a along the outer surface of the pinna a, as shown in FIGS. 5 and 6.

When the earphone device is worn by the user, the pinna inserting portion 5 is inserted into the pinna a so that its distal end faces the auditory canal b.

The pinna inserting portion 5, formed on the acoustic duct 2, is formed to be of such a length that, when the pinna inserting portion 5 is attached to the pinna with its distal end facing the auditory canal b, the bent portion 6 connecting to the main tube portion 7 faces the surface of the pinna a. The main duct portion 7 is connected to the pinna inserting portion 5 via the bent portion 6 having an acute angle substantially equal to or slightly smaller than approximately 90°. The main duct portion 7 has a side 8 opposite to its side connected to the pinna inserting portion 5 bent in a U-shape for upstanding towards the bent portion 6. The opposite side 8 of the main tube portion 7 is bent in an opposite direction to that of protrusion of the pinna inserting portion 5. By bending the main tube portion 7 extending outside of the pinna a in a U shape, the acoustic duct 2 may be configured to take up a relatively small space while having a sufficiently longer length.

Figure 7:
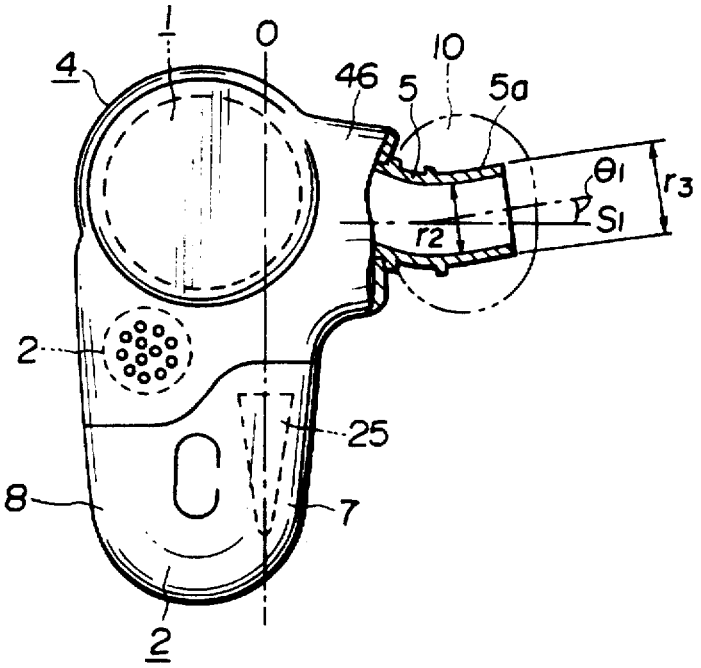
FIG. 7 is a front view showing the inclined state of a pinna inserting portion.
Figure 8:
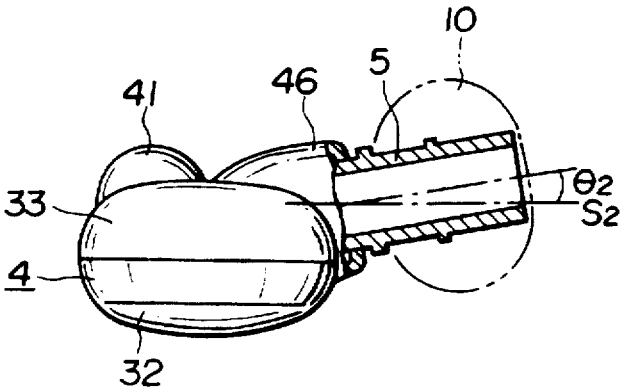
FIG. 8 is a top view showing the inclined state of a pinna inserting portion.

The pinna inserting portion 5 has a distal end 5*a* inserted into the pinna a for facing an entrance of the auditory canal b. The distal end 5*a* is inclined upwards with an inclination angle $\theta_1$ of approximately 10° relative to a plane $S_1$ perpendicular to an axis 0 of the main duct portion 7, as shown in FIG. 7. Moreover, the distal end 5*a* is inclined at an inclination angle of approximately 10° relative to a surface $S_2$ parallel to the axis 0 of the main duct portion 7 in a horizontal plane as shown in FIG. 8. By inclining the distal end 5*a* of the pinna inserting portion 5 relative to the main duct portion 7, the pinna inserting portion may be introduced smoothly into the auditory canal b extending into the inside of the head at an inclination relative to the surface of the pinna a, while the main duct portion 7 is extended along the surface of the pinna a.

In order that the sound reflected back from the eardrum will be incident on the acoustic duct 2 without reflection by the extreme end portion of the pinna inserting portion 5 when the acoustic duct 2 is mounted on the pinna with the extreme end of the pinna inserting portion 5 facing the entrance to the auditory canal b, the acoustic duct 2 is formed to have an inner diameter $r_2$ substantially equal to a diameter $r_i$ of an auditory canal b of a person of an ordinary stature., as shown in FIG. 7. The acoustic duct 2 has an outer diameter $r_3$ approximately equal to 6 mm in order to provide a duct wall thickness sufficient to assure a mechanical strength of the acoustic duct 2 formed by molding synthetic resin.

Figure 3:
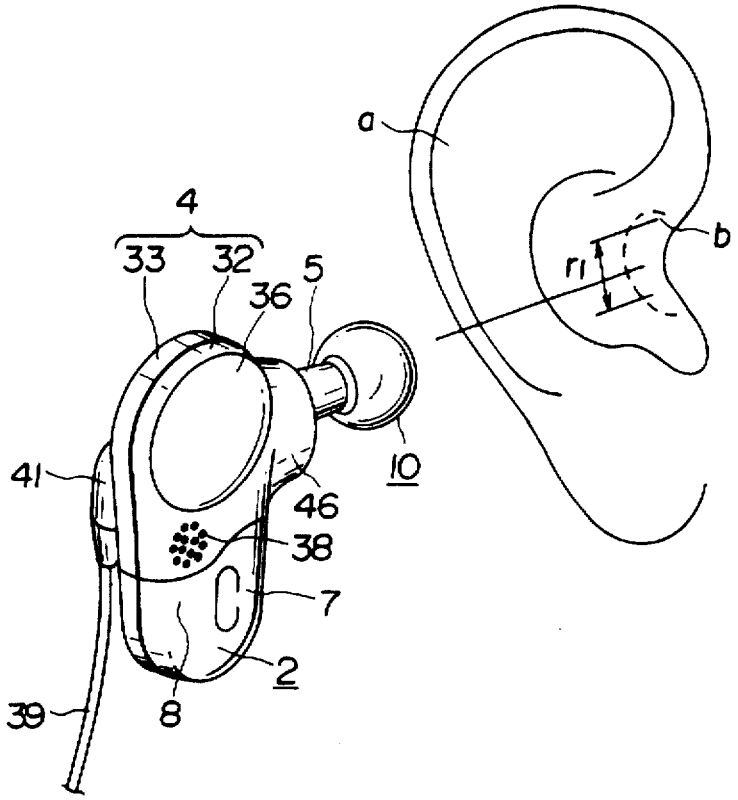
FIG. 3 is a perspective view showing an earphone device according to the present invention looking at a surface thereof showing the sound radiating surface of a microphone unit.
Figure 4:
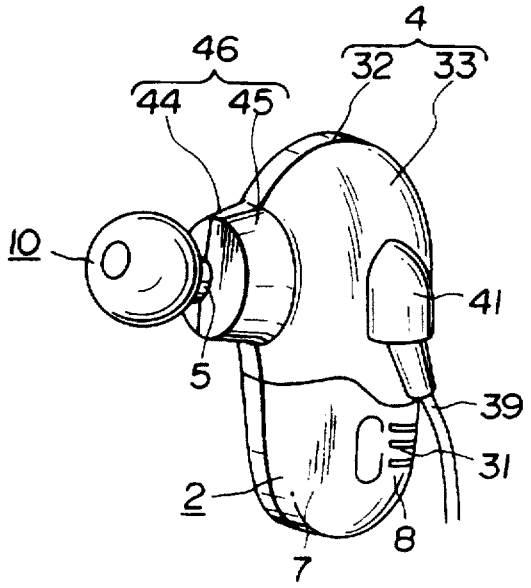
FIG. 4 is a perspective view of the earphone device of FIG. 3 looking from a cord holding portion.
Figure 9:
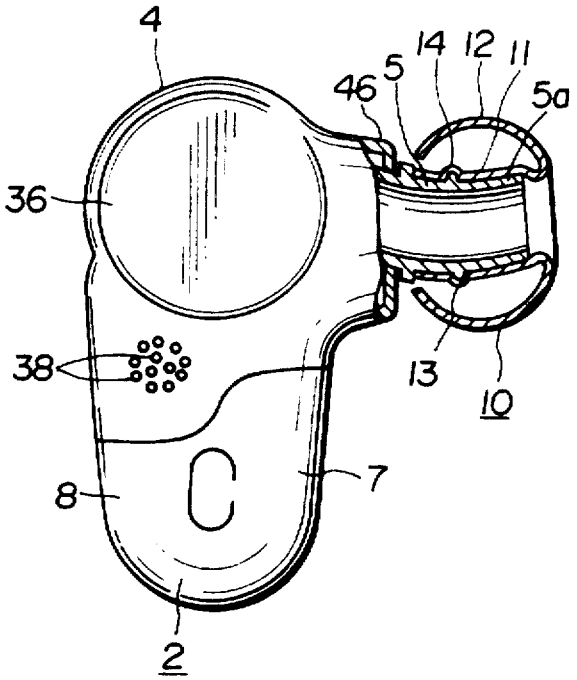
FIG. 9 is a front view showing the attached state of the attachment to the pinna inserting portion, partially broken away.

The distal end of the pinna inserting portion 5 mounted on the acoustic duct 2 has an attachment 10 which is formed of an elastic material, such as rubber, and which is fitted in the entrance to the auditory canal b for stopping the auditory canal b on attachment to the pinna a for assuring stable attachment to the pinna a of the acoustic duct 2, as shown in FIGS. 3 and 4. This attachment 10 has a tubular mounting portion 11 fitting on the outer periphery of the distal end of the pinna inserting portion 5 and an auditory canal fitting portion 12 formed on the outer periphery of the mounting portion 11, as shown in FIG. 9. This auditory canal fitting portion 12 is formed on the outer periphery of the mounting portion 11 by having its one end connected to the distal end of the mounting portion 11 and by being swollen in shape towards the proximal end of the mounting portion 11. That is, the auditory canal fitting portion 12, formed of an elastic material, such as rubber, has its end facing the auditory canal b as a connecting portion to the mounting portion 11 and has its opposite end as a free end portion. Thus, if the auditory canal fitting portion 12 is fitted into the auditory canal b, with its connecting portion to the mounting portion 11 as an inserting portion, the auditory canal fitting portion 12 may be easily elastically flexed to conform to the auditory canal b and fitted in this state in the auditory canal b.

The inner peripheral surface of the mounting portion 11 has an engagement groove 14 engaged by an engagement protrusion 13 formed on the outer peripheral surface of the pinna inserting portion 5. By introducing the mounting portion 11 into the pinna inserting portion 5 with the engagement groove 14 being engaged by the engagement protrusion 13, the attachment portion 10 may be mounted in position relative to the pinna inserting portion 5 without the risk of detachment from the pinna inserting portion 5.

The auditory canal fitting portion 12 is preferably elastically flexible to conform to the auditory canal b so as to hermetically seal the auditory canal b when the fitting portion 12 is fitted into the auditory canal b. On the other hand, the mounting portion 11 of the attachment portion 10 is preferably of sufficient elasticity since it is used for having the attachment portion 10 reliably supported by the pinna inserting portion 5. Consequently, while the auditory canal fitting portion 12 is of a thin wall thickness in order to have sufficient elasticity, the mounting portion 11 is formed with a wall thickness substantially thicker than the wall thickness of the auditory canal fitting portion 12 in order to have a sufficient fitting holding force.

The auditory canal fitting portion 12 and the mounting portion 11 of the attachment portion 10 may be formed as one from different materials for exhibiting their respective functions satisfactorily. For example, the auditory canal fitting portion 12 may be formed of silicon rubber capable of being easily elastically deformed, while the mounting portion 11 may be formed of an elastic material, such as rubber.

In the vicinity of the bent portion 6 of the acoustic duct 2, there is formed a playback sound inlet port 15 for allowing the reproduced sound radiated from the speaker unit 1 to enter the duct, as shown in FIG. 5. The speaker unit 1 is mounted via a speaker attachment piece 16 protuberantly formed on a lateral side edge of the inlet port 15.

The speaker unit 1, mounted via speaker mounting piece 16, is comprised of a dynamic speaker 17 housed within a capsule 18. The dynamic speaker is made up of a diaphragm and a magnetic circuit driving the diaphragm. The front side of the capsule 18 is a curved surface 18*a* curved uniformly to conform to the arcuately-swollen diaphragm constituting the speaker 17, as shown in FIG. 6. The front side of the capsule 18 is formed with a plurality of sound radiating apertures 19 for radiating the reproduced sound radiated from the speaker 17. The back side of the capsule 18 is also formed with a plurality of sound radiating apertures 20 for radiating the reproduced sound radiated from the speaker 17.

Figure 10:
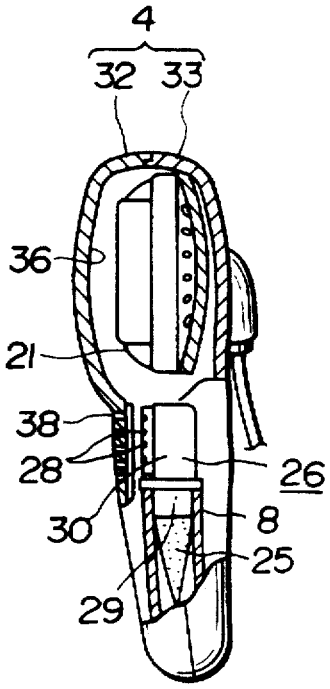
FIG. 10 is a longitudinal cross-sectional view showing the attached state of a speaker unit and a microphone unit within a housing.
Figure 11:
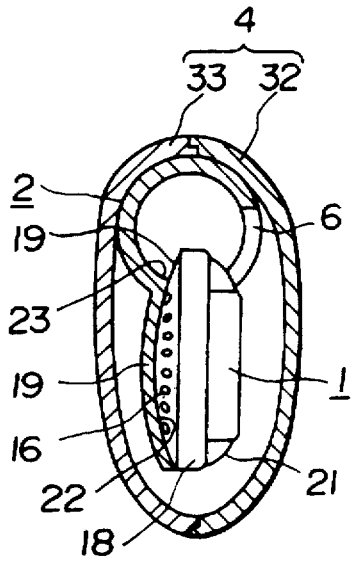
FIG. 11 is a cross-sectional view showing the attached state of a speaker unit to a speaker attachment piece.

On the back side of the capsule 18, a cover plate 21 is mounted to cover the sound radiating apertures 20 on the back side of the capsule 18, as shown in FIG. 10. The cover plate 21 controls the radiation to the outside of the reproduced sound radiated from the back side of the speaker to prohibit deterioration of the reproduced sound radiated from the back side of the speaker otherwise caused by re-entrance of the reproduced sound from the back side of the speaker into the acoustic duct 2.

The speaker mounting piece 16, carrying the above-described speaker unit 1, is protruded from the vicinity of the bent portion 6 substantially parallel to the direction of extension of the pinna inserting portion 5, as shown in FIGS. 5 and 6. The speaker mounting piece 16 is formed as a disk sized to conform to the outer shape of the speaker unit 1, and a recessed speaker unit mounting portion 22 conforming to the curved surface 18*a* on the front side of the capsule 18 is formed at a mid portion of the speaker mounting portion 16. The side of the speaker unit mounting portion 22 connected to the acoustic duct 2 is formed with a communicating portion 23 communicating with the playback sound inlet port 15. The speaker unit 1 is mounted on the speaker mounting piece 16 with the curved surface 18*a* of the capsule 18 being fitted to the speaker unit mounting portion 22. The speaker unit 1, mounted on the speaker mounting piece 16, is mounted in position with the curved surface 18*a* being secured to the speaker mounting piece 16 by an adhesive or a double-sided adhesive tape. Since the speaker unit 1 is mounted in position with the curved surface 18*a* on the front side of the capsule 18 being secured to the speaker mounting portion, the speaker unit can be securely mounted on the mounting piece 16.

With the speaker unit 1 attached to the speaker mounting piece 16 as described above, part of the sound radiating apertures 19 formed in the front surface of the capsule 18, such as two sound radiating apertures 19, face the communicating portion 23. The playback sound radiated from the speaker unit enters the acoustic duct 2 via the communication portion 23 and the sound radiating apertures facing the communicating portion 23.

On the opposite side 8 of the U-shaped acoustic duct 2 is mounted a sound absorbing material piece 25 adapted for absorbing the reflected sound entering the acoustic duct 2 after reflection by the eardrum, as shown in FIG. 7. The opposite end 8 is designed as a non-reflecting end. The sound absorbing material piece 25 is formed by molding porous expanded urethane and is conically-shaped with a tapered distal end. The sound absorbing material piece 25 is inserted into the acoustic duct 2 with the tapered end first and fitted in the opposite end 8. If necessary, the sound absorbing material piece 25 is secured within the acoustic duct 2 with an adhesive at a pre-set mounting position.

On the opposite end 8 of the acoustic duct 2 is fitted the microphone unit 3 via a microphone supporting member 26 for collecting the sound of the external environment. The microphone unit 3 has a cylindrically-shaped microphone capsule 27 within which is housed a microphone element. The sound collecting surface of the microphone capsule 27 faced by the diaphragm of the microphone element is formed with plural sound collecting holes 28, as shown in FIG. 5. The sound from the external environment enters the microphone capsule 27 via the sound collecting holes 28 so as to be collected by the microphone element.

The microphone supporting member 26 for supporting the microphone unit 3 on the opposite end 8 of the acoustic duct 2 is made up of a fitting lug 29 fitted to the opposite end 8 of the acoustic duct 2 and an arcuate-shaped microphone holder 30 formed as one with the distal end of the fitting lug 29. The microphone unit 3 is held by the microphone supporting member 26 by having the cylindrically-shaped microphone capsule 27 fitted in the microphone holder 30. The microphone supporting member 26, in turn, causes the microphone unit 3 to be mounted on the acoustic duct 2 by having the fitting lug 29 fitted to the opposite end 8 of the acoustic duct 2.

The microphone unit 3 is mounted on the acoustic duct 2 in an orientation opposite to the orientation in which the speaker unit 1 is supported by the acoustic duct 2 via the mounting piece 16, as shown in FIG. 5. That is, the microphone unit 3 is mounted so that its sound collecting surface is directed in an opposite direction to that of the sound radiating surface of the speaker unit 1. By reversing the direction of orientation of the sound collecting surface of the microphone unit 3 with respect to that of the speaker unit 1, the reproduced sound radiated by the speaker unit 1 may be prevented from entering the microphone unit 3 thus inhibiting resonation of the sound reproduced by the speaker unit 1.

It suffices if the microphone unit 3 and the speaker unit 1 are mounted in orientations that suppress the entrance of the reproduced sound radiated from the speaker unit 1 to the microphone unit 3. Thus the microphone unit 3 and the speaker unit 1 may be mounted so that the sound collecting surface and the sound radiating surface thereof are at right angles to each other.

Since the microphone supporting member 26 is fitted to the opposite end 8 of the acoustic duct 2, the terminal end of the acoustic duct 2 is stopped. Consequently, the sound radiated towards the opposite end 8 of the acoustic duct 2 cannot be radiated to outside the acoustic duct 2. Thus, a plurality of sound extracting ports 31 are formed in the lateral surface towards the opposite end 8 of the acoustic duct 2 for radiating the sound transmitted to the opposite end 8 of the acoustic duct 2 to outside. The sound extracting ports 31 are formed in the lateral surface towards the opposite end 8 of the acoustic duct 2 positioned on the opposite side thereof with respect to duct side facing the sound collecting surface of the microphone unit 3, as shown in FIGS. 4 and 6. By forming the sound extracting holes 31 in such position, the opened state may be maintained, even if the user covers the earphone device attached to his or her pinna with his or her hand, so that the sound radiated by the sound extracting ports 31 will unlikely be collected by the microphone unit 3, thus prohibiting resonation of the reproduced sound of the speaker unit 1.

The speaker unit 1 and the microphone unit 3, thus attached to the acoustic duct 2, are housed within the housing 4 which is mounted for enclosing a mid portion of the acoustic duct 2 inclusive of the bent portion 6 for constituting a main earphone member. The housing 4 is made up of a front side half 32 and a rear side half 33, molded as a pair from synthetic resin, as shown in FIGS. 5 and 6.

The opposing abutting surfaces of the front side half 32 and the back side half 33 making up the housing 4 are formed with fitting recesses 34, 35, respectively, for fitting the acoustic duct 2 therein, as shown in FIGS. 5 and 6. The front side half 32 is formed with a speaker housing recess 36 for housing a rearwardly protruding magnetic circuit section 1*a* of the speaker unit 1 mounted on the speaker mounting piece 16 and a microphone housing recess 37 for housing the sound collecting surface side of the microphone unit 3. The microphone housing recess 37 is formed with a plurality of small-sized inlet ports 38 for admitting the sound of the external environment. The rear side half 33 is provided with a cord holder 41 for holding an external connection cord 30 drawn out of the speaker unit 1 and the microphone unit 3 for setting the draw-out direction of the external connection cord 39. The cord holder 41 is formed on the lateral surface of the rear side half 3 and has a terminal cord passage portion 42. The external connection cord 39 is passed through the cord passage portion 42 formed on the terminal portion of the cord holder 41 so as to be extended out of the housing 4.

To an extended portion of the external connection cord 39 from the cord passage portion 42 is fitted a bushing 43 formed of a flexible material, such as rubber. The purpose of the bushing 43 is to prevent the extended portion of the external connection cord 39 from the cord passage portion 42 from being warped significantly and for safeguarding the cord against possible breakage.

The external connection cord 39, pulled out from the speaker unit 1, operates as an input line of speech signals to the speaker unit 1, whereas the external connection cord 39 drawn out of the microphone unit 3 operates as an output line of the speech signals collected by the microphone unit 3.

The cord holder 41 may be formed separately from the rear side half 33 and mounted integrally with the lateral surface of the rear side half 33. In this case, the rear side half 33 is formed with a cord lead-out port communicating with the cord passage portion 42 provided on the cord holder 41. By forming the cord holder 41 separately from the rear side half 33, the cord holder 41 may be formed of a material different from the tough synthetic material of the rear side half 33. The cord holder 41 may be formed of a soft elastic material, such as rubber, for assuring agreeable feeling on attachment of the earphone device to the pinna even if the cord holder 41 is partially contacted with the pinna.

The front side half 32 and the rear side half 33 making up the housing 4 are formed with semispherically-shaped portions 44, 45 fitted to the proximal end of the pinna inserting portion 5 formed on one end of the acoustic duct 2. When abutted and connected to each other, these semispherically-shaped portions 44, 45 make up a pinna insertion control portion 46 larger in diameter than the acoustic duct 2.

The above-described front side half 32 and rear side half 33 are arranged facing each other with the acoustic duct 2 in-between. The mid portion of the acoustic duct 2 is fitted in the fitting recesses 34, 35 formed in these halves 32, 33 which are then coupled to each other with abutment surfaces 32*a*, 33*a* thereof abutted to each other for constituting the housing 4 overlying the mid portion of the acoustic duct 2, as shown in FIGS. 3 and 4. Within the housing 4, the speaker unit 1 is housed within the speaker housing recess 36 formed in the front side half 32, while the microphone unit 2 is housed within the microphone housing recess 37, as shown in FIG. 19. If the front side half 32 and the rear side half 33 are abutted and connected together to constitute the housing 4, there is defined on the proximal end of the pinna inserting portion 5 a pinna insertion control portion 46 larger in diameter than the acoustic duct 2.

Meanwhile, there is formed a gap between the sound collecting surface 3*a* of the microphone unit 3 housed within the housing 4 and the bottom surface of the microphone housing recess 37, and an air screen 45 formed of, for example, a non-woven fabric, is arranged in this gap for preventing a hissing sound from being generated during sound collection via inlet holes 38 formed in the microphone housing recess 37, as shown in FIG. 10. There is also provided a sound absorbing material piece of, for example, expanded urethane or felt, not shown, between the microphone unit 3 and the housing 4. This sound absorbing material piece absorbs vibrations transmitted via the housing 4 to the microphone unit 3. This sound absorbing material piece absorbs the vibrations transmitted via the housing 4 to the microphone unit 3. By providing such sound absorbing material piece, the microphone unit 3 can collect the sound of the external environment without collecting the noise.

Figure 12:
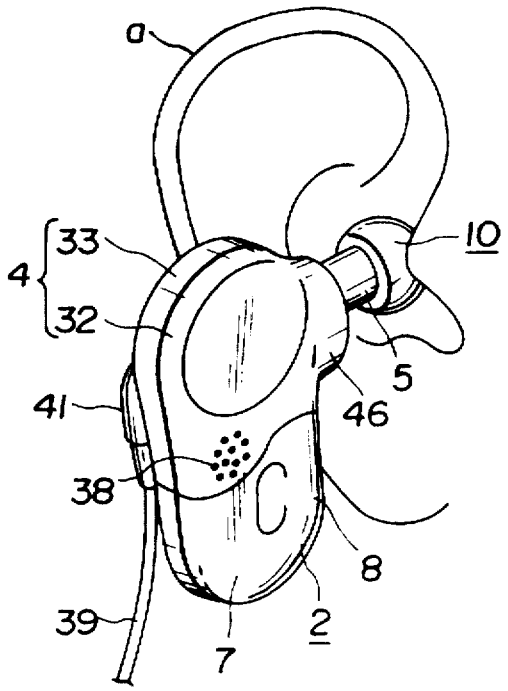
FIG. 12 is a perspective view showing the attached state of the earphone device of FIG. 3 to the pinna.
Figure 13:
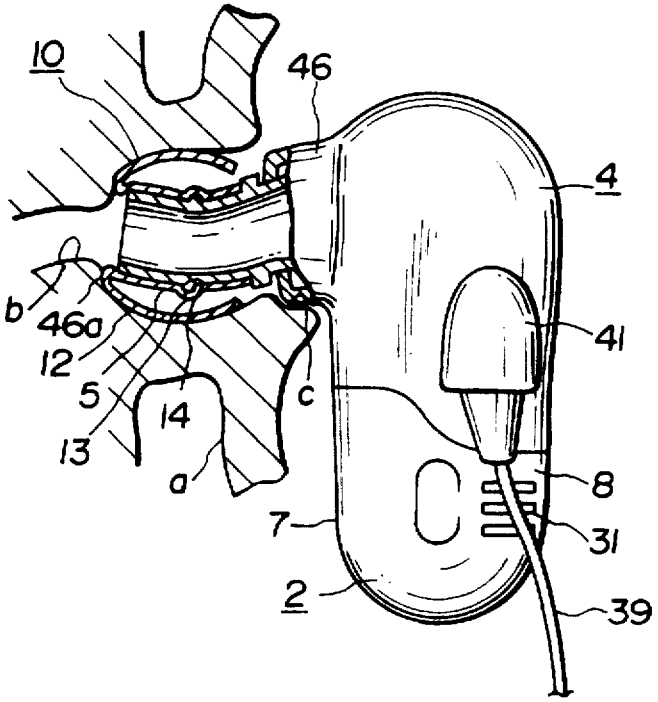
FIG. 13 is a back side view showing the state of fitting of the attachment in the auditory canal, with a portion being broken away.

The above-described earphone device is attached by fitting the attachment 10 mounted on the distal end of the pinna inserting portion 5 provided on one end of the acoustic duct 2 into the auditory canal b, with the main duct position 7 of the acoustic duct 2 then depending along the surface of the pinna a, as shown in FIG. 12. At this time, the auditory canal fitting portion 12 of the attachment 10 is fitted in the auditory canal b, as it is deformed elastically, as shown in FIG. 13. The auditory fitting portion 12 is formed of an elastically deformable material, such as rubber, and hence is deformed in conformity to the shape of the auditory canal b for hermetically sealing the auditory canal b. Since the auditory canal b is hermetically sealed by the auditory canal fitting portion 12 of the attachment 10 on attachment of the earphone device, it becomes possible to suppress the sound from the external environment other than the reproduced sound radiated from the earphone device.

When the earphone device is attached to the pinna a, the sound collecting surface of the microphone unit 3 is directed to outside the pinna a, as shown in FIG. 12, thus enabling the sound of the external environment to be collected efficiently. Moreover, when the earphone device is attached to the pinna a, the cord holder 41 is positioned on the back side surface of the housing 4 facing the pinna a, so that the external connection cord 39 may be pulled out via an area defined between the pinna a and the housing 4, as shown in FIG. 12. Thus the external connection cord 39 may be pulled out downwardly of the pinna a without pulling the external connection cord 39 out of the earphone device. By providing the cord holder of an extending length, the external connection cord 39 can be pulled downwardly of the pinna a without being contacted therewith for assuring a stable attachment state.

Moreover, when the earphone device is attached to the pinna a, an end face 46*a* of the pinna insertion control portion 46 formed at the proximal portion of the pinna inserting portion 5 with a diameter larger than the diameter of the acoustic duct 2 is caused to bear against the bottom of the outer ear cavity of the pinna a, as shown in FIG. 13. Thus the tough pinna inserting potion 5 can be prohibited from being excessively inserted into the auditory canal b, thus assuring safe attachment.

The above-described earphone device has the housing 4 formed as one with the attachment 10 and the pinna insertion control portion 46, while the attachment 10 and the pinna insertion control portion 46 are formed as components independent of each other. The attachment 10 has the auditory canal fitting portion 12 for hermetically sealing the auditory canal b and the pinna insertion control portion 46 is designed to control insertion of the pinna inserting portion 5 into the auditory canal b. The attachment 10 may, however, be formed as one with the pinna insertion control portion 46, in which case the pinna insertion control portion 46 formed on the housing 4 is omitted.

An embodiment of the earphone device according to the present invention, in which the pinna fitting portion is formed as one with the pinna insertion control portion, is now explained.

In the following description, parts or components used in common with the above-described embodiment are denoted by the same reference numerals and the detailed description is not made.

Figure 16:
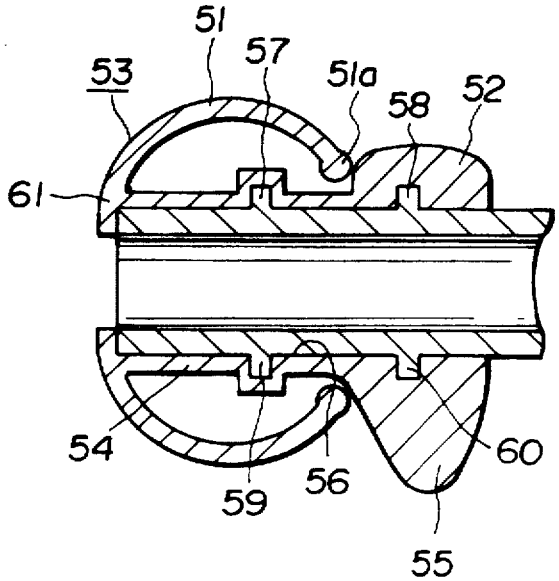
FIG. 16 is a cross-sectional view showing an integrated attachment attached to the earphone device.

With the earphone device of the modified embodiment, an attachment 53, integrally formed with a pinna fitting portion 51, at least partially fitted into and hermetically sealing the auditory canal b, and with a pinna insertion control portion 52, is mounted at the distal end of the pinna insertion portion 5 formed at one end of the acoustic duct 2, as shown in FIG. 16.

The pinna fitting portion 52, formed on the outer periphery of a mounting portion 54, has its one end connected to the distal end of the mounting portion 54 and is designed for being swollen in shape towards the proximal end of the mounting portion 54. That is, the pinna fitting portion 52 is formed integrally with the mounting portion 54, with its end portion as a side protruding into the auditory canal b operating as a connecting portion to the mounting portion 54 and with its opposite end portion operating as a free portion, in such a manner that the auditory canal fitting portion is swollen substantially spherically for covering the outer peripheral surface of the mounting portion 54.

Figure 14:
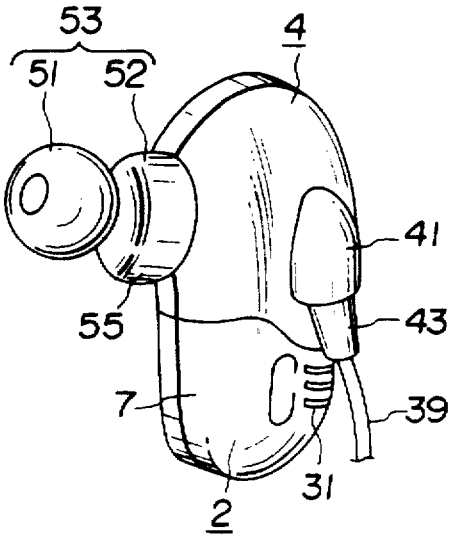
FIG. 14 is a perspective view showing another embodiment of an earphone device according to the present invention, looking from the surface thereof showing the sound radiating surface of a microphone unit.
Figure 15:
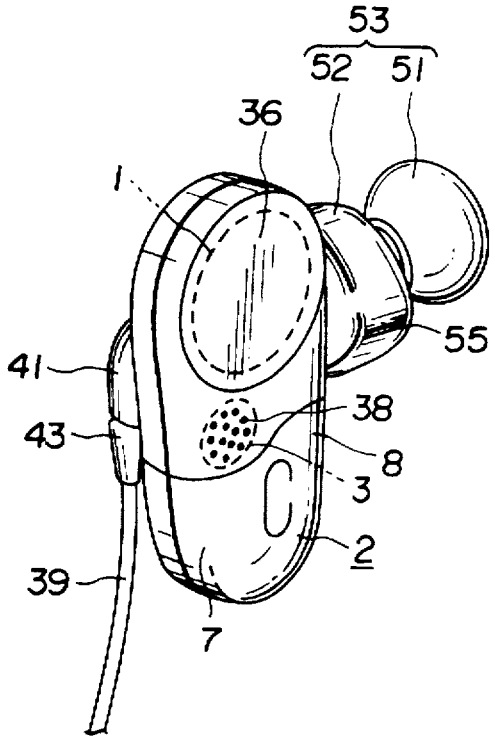
FIG. 15 is a perspective view of the earphone device of FIG. 14, looking from a cord holding portion.

The pinna insertion control portion 52, controlling the inserting position into the auditory canal b of the attachment 53 and the pinna inserting portion 5 carrying the attachment 53, has a diameter larger than the outer diameter of the acoustic duct 2 and a size at least incapable of being inserted into the auditory canal b, and is formed for being swollen in shape towards the proximal end of the mounting portion 54. The pinna insertion control portion 52 is shaped to be fitted into and retained by an outer ear cavity c when the earphone device is attached to the pinna. To this end, the pinna insertion control portion 52 has a laterally protruding engagement portion 55 engaged in a portion of the outer ear cavity c, as shown in FIGS. 14 and 15.

The inner surface of a fitting hole 56, formed for extending from the mounting portion 54 to the pinna insertion control portion 52, is formed with engagement grooves 59, 60 for mating with engagement lugs 57, 58 formed on the outer peripheral surface of the pinna inserting portion 5. The attachment 53 is mounted on the outer peripheral side of the pinna inserting portion 5 by fitting the attachment in the fitting hole 56. At this time, the engagement grooves 59, 60 formed on the inner peripheral surface of the fitting hole 56 are engaged by the engagement lugs 57, 58 formed on the outer peripheral surface of the pinna inserting portion 5, as shown in FIG. 16, for positioning the attachment and for preventing detachment thereof from the pinna inserting portion 5.

The distal end of the mounting portion 54 is formed with a ring-shaped flange 61 covering the end face of the pinna inserting portion 5, as shown in FIG. 16. When the mounting portion 54 is attached to the pinna a, the flange 61 prevents the distal end of the tough mounting portion 54 from being directly abutted against the auditory canal b for assuring soft attachment feeling.

Meanwhile, the auditory canal fitting portion 51 is preferably formed so as to be readily elastically deformed to conform to the auditory canal b on attachment of the auditory fitting portion 51 to the auditory canal b. The mounting portion 54 of the attachment 53, designed for having the attachment 53 positively supported by the pinna inserting portion 5, is preferably formed to have sufficient elasticity. On the other hand, the pinna insertion control portion 52, fitted in the outer ear cavity c for controlling the insertion position of the auditory fitting portion 51 and the pinna inserting portion 5 into the auditory canal b, is preferably formed so as not to be deformed easily.

To this end, the auditory fitting portion 51 is of a thin wall thickness to permit elastic deformation easily, while the mounting portion 54 is larger in wall thickness than the auditory canal fitting portion 51 in order to have a sufficient fitting holding power. The pinna insertion control portion 52 is also larger in wall thickness so as not to be deformed easily.

The auditory canal fitting portion 51, mounting portion 54 and the pinna insertion control portion 52 of the attachment 53 may also be formed integrally of different materials in order to exhibit their respective functions. For example, the auditory canal fitting portion 51 is formed of silicon rubber that may be deformed elastically easily, while the mounting portion 54 and the pinna insertion control portion 52 are formed of a highly elastic material, such as rubber. The free end of the auditory canal fitting portion 51 is formed with a columnar-shaped enlargement 51*a* for preventing cracks beginning from the free end.

Figure 17:
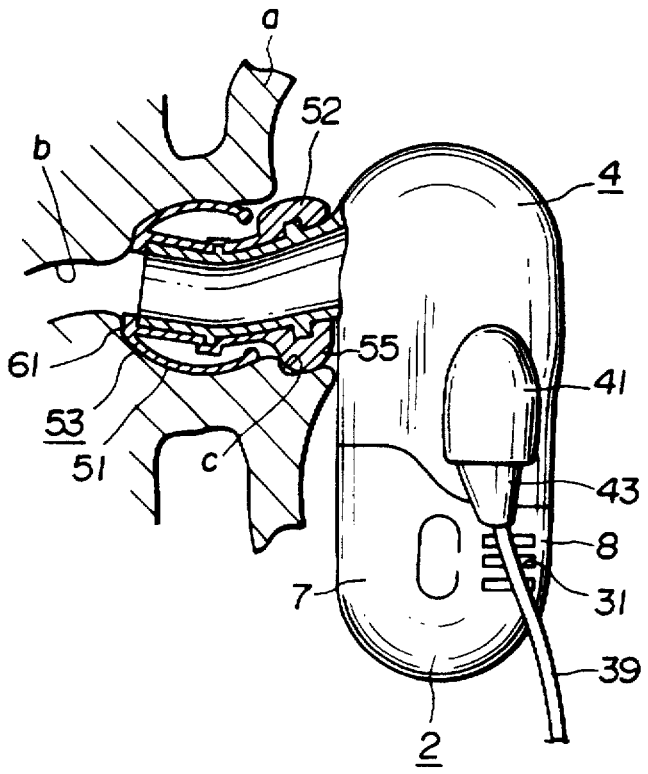
FIG. 17 is a back side view showing the attached state of the earphone device shown in FIG. 14.

The earphone device, having the above-described attachment 53 attached to the distal end of the pinna inserting portion 5 provided on one end of the acoustic duct 2, is attached in position with the main duct portion 7 of the auditory duct 2 depending along the surface of the pinna a, with the attachment 53 being fitted in the auditory canal b and with the main duct portion 7 of the acoustic duct 2 being retained in a portion of the outer ear cavity c for fitting the pinna insertion control portion 52 in the outer ear cavity c, as shown in FIG. 17. At this time, the auditory canal fitting portion 12 of the attachment 53 is fitted into and hermetically seals the auditory canal b as it is deformed elastically, as shown in FIG. 17. At this time, the engagement portion 55 formed on the pinna insertion control portion 52 is retained by a portion of the outer ear cavity c for controlling the amount of insertion of the auditory canal fitting portion 51 and the pinna insertion portion 5 into the auditory canal b. Consequently, the auditory canal fitting portion 51 and the tough pinna inserting portion 5 may be prohibited from being excessively inserted into the auditory canal b thus assuring safe attachment.

The above-described earphone device is of the noise-reduced type having the microphone unit 3 along with the speaker unit 1 and is configured for reducing the noise entering the device from outside for suppressing distortion in the reproduced sound radiated from the speaker unit 1 thereby enabling the reproduced sound to be heard with optimum playback characteristics. However, the present invention may directly be applied to an earphone device having a speaker unit 1 and a non-reflection type acoustic duct 2 adapted for allowing the reproduced sound radiated from the speaker unit 1 to enter the pinna.

In addition, the present invention may be directly applied to an electro-acoustic transducer, such as a hearing aid, having a microphone unit and a speaker unit attached to the pinna.

We claim:

1. An electro-acoustic transducer comprising:

a main body portion housing at least a speaker unit;

a pinna inserting portion protruding from said main body portion and adapted for being inserted into a pinna of a user, wherein said pinna inserting portion includes a segment bent to an angle of approximately 90° and a U-shaped duct portion;

an elastically deformable auditory canal fitting portion provided around an outer periphery of said pinna inserting portion, said auditory canal fitting portion being flexibly deformable to conform to a shape of an auditory canal upon insertion therein and to securely attach said pinna inserting portion to said pinna of said user; and an insertion control portion for controlling an insertion position and preventing excess insertion of said auditory canal fitting portion into said auditory canal of said user.

2. The electro-acoustic transducer as claimed in claim 1, wherein said auditory canal fitting portion and said insertion control portion are integrally formed.

3. A pinna attachment for an electro-acoustic transducer, said pinna attachment comprising:

a mounting portion protruding from a main body portion of an electro-acoustic transducer housing at least a speaker unit, said mounting portion being fitted to a pinna insertion portion for insertion into a pinna of a user;

an elastically deformable auditory canal fitting portion having a first end connected to a distal end of said mounting portion and having a free second end, wherein said auditory canal fitting portion has a generally spherical shape that flexibly deforms to conform to a shape of an auditory canal upon insertion therein and that covers an outer periphery of said mounting portion; and an insertion control portion formed on a proximal end of said mounting portion and extending from the main body, said insertion control portion having an outer circumference larger than an outer circumference of said pinna insertion portion for preventing excess insertion of said auditory canal fitting portion into said auditory canal of said user.

4. The pinna attachment as claimed in claim 3, wherein said free second end of said auditory canal fitting portion is formed of an elastically deformable material and is formed integrally with an an enlarged portion having a columnar cross-section.

5. The electro-acoustic transducer as claimed in claim 1, wherein said elastically deformable auditory fitting portion hermetically seals said auditory canal and suppresses external noises from entering said auditory canal of said user.

6. The electro-acoustic transducer as claimed in claim 1, wherein said auditory canal fitting portion is formed of silicon rubber.

7. The pinna attachment as claimed in claim 3, wherein said elastically deformable auditory fitting portion hermetically seals said auditory canal and suppresses external noises from entering said auditory canal of said user.

8. A pinna attachment for an electro-acoustic transducer, said pinna attachment comprising:

a mounting portion protruding from a main body portion of an electro-acoustic transducer housing at least a speaker unit, said mounting portion being fitted to a pinna insertion portion for insertion into a pinna of a user, wherein said pinna insertion portion includes a segment bent to an angle of approximately 90° and a U-shaped duct portion;

an elastically deformable auditory canal fitting portion having a first end connected to a distal end of said mounting portion and having a free second end, wherein said auditory canal fitting portion has a generally spherical shape that flexibly deforms to conform to a shape of an auditory canal upon insertion therein and that covers an outer periphery of said mounting portion; and an insertion control portion formed on a proximal end of said mounting portion.

9. The pinna attachment as claimed in claim 3, wherein said auditory canal fitting portion is formed of silicon rubber.

* * * * *